United States Patent [19]

Zimmerman

[11] Patent Number: 5,048,690

[45] Date of Patent: Sep. 17, 1991

[54] CARTON AND BLANK FOR MAKING SAME

[75] Inventor: Joel Zimmerman, Elizabeth, N.J.

[73] Assignee: Revlon, Inc., New York, N.Y.

[21] Appl. No.: 400,411

[22] Filed: Aug. 30, 1989

[51] Int. Cl.[5] ..... B65D 5/48; B65D 5/54

[52] U.S. Cl. ..... 206/602; 206/44 R; 229/120.11; 229/120.18

[58] Field of Search ..... 229/120.01, 120.11, 229/120.18; 206/602, 44 R

[56] References Cited

U.S. PATENT DOCUMENTS

| | | | |
|---|---|---|---|
| 1,899,772 | 2/1933 | Richardson . | |
| 2,098,090 | 11/1937 | Ford | 206/602 |
| 2,287,729 | 6/1942 | Fallert | 206/602 |
| 2,684,178 | 7/1954 | Keeler | 206/602 |
| 2,964,169 | 12/1960 | Brachman | 206/44 R |
| 2,973,130 | 2/1961 | Cottrill | 206/602 |
| 3,048,321 | 8/1962 | Sanford | 206/602 |
| 3,135,457 | 6/1964 | Risucci | 206/602 |
| 3,143,273 | 8/1964 | Bunting et al. | 206/602 |
| 3,158,312 | 11/1964 | Simkins | 206/602 |
| 3,166,229 | 1/1965 | Sherman et al. . | |
| 3,341,103 | 9/1967 | May | 206/602 |
| 3,510,046 | 5/1970 | Reiner | 206/602 |
| 3,677,458 | 7/1972 | Gosling | 206/602 |
| 4,197,981 | 4/1980 | Hamilton . | |
| 4,228,945 | 10/1980 | Wysocki | 206/602 |
| 4,256,223 | 3/1981 | Pawlowski | 206/45.11 |
| 4,913,291 | 4/1990 | Schuster | 206/602 |
| 4,919,269 | 4/1990 | Wright et al. | 206/602 |

*Primary Examiner*—Gary E. Elkins

*Attorney, Agent, or Firm*—Julie Blackburn

[57] ABSTRACT

A plural shipping carton fabricated from a unitary blank includes two side-by-side units that are covered by a top consisting of a single rear end flap, two side flaps, and two front end flaps. Both units have solid inner panels which attach together. The plural carton is split into the two independent units by separating the inner panels. The plural carton is adapted for display by cutting around the periphery of the plural carton to remove the top, and removing substantial portions of the face surface, but leaving the inner panels in tact. The solid inner panels form a structural support member which cooperates with a rear panel to provide support for loads placed upon the plural carton. Thus, a storage system can be formed by stacking a plurality of identical plural cartons one on top of the other.

15 Claims, 8 Drawing Sheets

CARTON AND BLANK FOR MAKING SAME

FIELD OF THE INVENTION

The present invention relates to corrugated cartons, and, more particularly, to a plural shipping carton that is splittable, stackable and adaptable for display.

BACKGROUND OF THE INVENTION

Many industries employ plural cartons to pack their products. One known splittable carton is disclosed in U.S. Pat. No. 1,899,772. An inner wall dividing the plural carton is separated in order to split the carton into two independent units. Such a carton can also be structurally adapted for display functions. However, a single plural carton is not structurally adaptable to accommodate both functions simultaneously.

Plural cartons adapted for display and display cartons, such as the one disclosed in U.S. Pat. No. 4,256,223, are not well suited for shipping products. Typically, such cartons are fabricated from a single ply of cardboard. While the single ply of cardboard is easy to cut, thus making it readily adaptable for display purposes, it offers little protection to products stored within the carton. Consequently, display cartons and single-walled plural cartons employed for the purpose of shipping products must be overpacked. Overpacking is, of course, time consuming and costly and, therefore, undesirable.

Shipping cartons and plural cartons adapted for shipping purposes, on the other hand, are not structurally suited for displaying products. One problem lies with removing the top of the shipping carton in order to display the products stored therein. Adhesive bonds sealing the top flaps of shipping cartons must be strong. As a result of these strong bonds, pulling the top flaps apart can be a formidable task. One convenient method to circumvent the step of pulling open the top flaps would be to cut around the periphery of the carton and remove the top portion. However, prior art plural cartons are not constructed to readily facilitate this method. Even if the periphery of the carton is out, the top portion is still attached to the inner wall. Detaching the top portion from the inner wall requires additional, often difficult, cutting. This problem is evident in many known shipping cartons. Yet additional cutting is required if the plural carton employs inner side flaps depending from the inner panels. In this case, the top portion also adheres to the inner side flaps. To detach the inner side flaps from the inner walls, the top portion must be folded back and the inner flaps must be cut away from the inner walls. Inner side flaps are employed by plural cartons, such as the one disclosed in U.S. Pat. No. 3,135,457.

Another problem with shipping cartons adapted for display is that they cannot be stacked. Stackable cartons are advantageous because they save storage space. Although many known shipping cartons possess sufficient strength to be stacked one atop another, they lose this strength when adapted for display. Too much structural support is lost when substantial portions of face surface are removed. As a result, heavy loads placed atop such cartons cause their walls to collapse.

SUMMARY OF THE INVENTION

The problems inherent in shipping cartons adapted for display are overcome by the present invention, which relates to a shipping carton fabricated from a unitary blank made of corrugated which can be adapted for display purposes. The plural carton has two independent containers which can store products of different sizes and display the products stored therein.

The plural carton includes a rear panel subdivided into first and second rear subpanels, opposed first and second outer panels connected to side edges of the rear panel, and first and second front panels opposed to the first and second rear panels, respectively, and connected to side edges of the first and second outer panels, respectively. First and second inner panels are connected to side edges of the first and second front panels, and are opposed to the first and second outer panels such that the plural carton is divided into a pair of side-by-side containers. The first and second inner panels are solid, and are attached together to form a structural support member having rigidity sufficient to support another carton placed thereupon. Thus, a storage system can be formed.

The top of the plural carton is covered by five flaps. A single flap is attached to an upper edge of the rear panel, two flaps are attached to upper edges of the first and second outer panels, and two flaps are attached to upper edges of the first and second front panels. The flaps do not attach to the first and second inner panels. To adapt the plural carton for display, the rear panel, first and second front panels, and first and second outer panels are cut in the vicinity of their upper edges. Next, the flaps are removed. Finally, portions of the first and second front panels are removed to expose the products stored within the two containers.

BRIEF DESCRIPTION OF THE DRAWINGS

For a better understanding of the present invention, reference is made to the following description of three exemplary embodiments considered in conjunction with the accompanying drawings, in which.

DETAILED DESCRIPTION OF THE EXEMPLARY EMBODIMENTS

Figure 1:
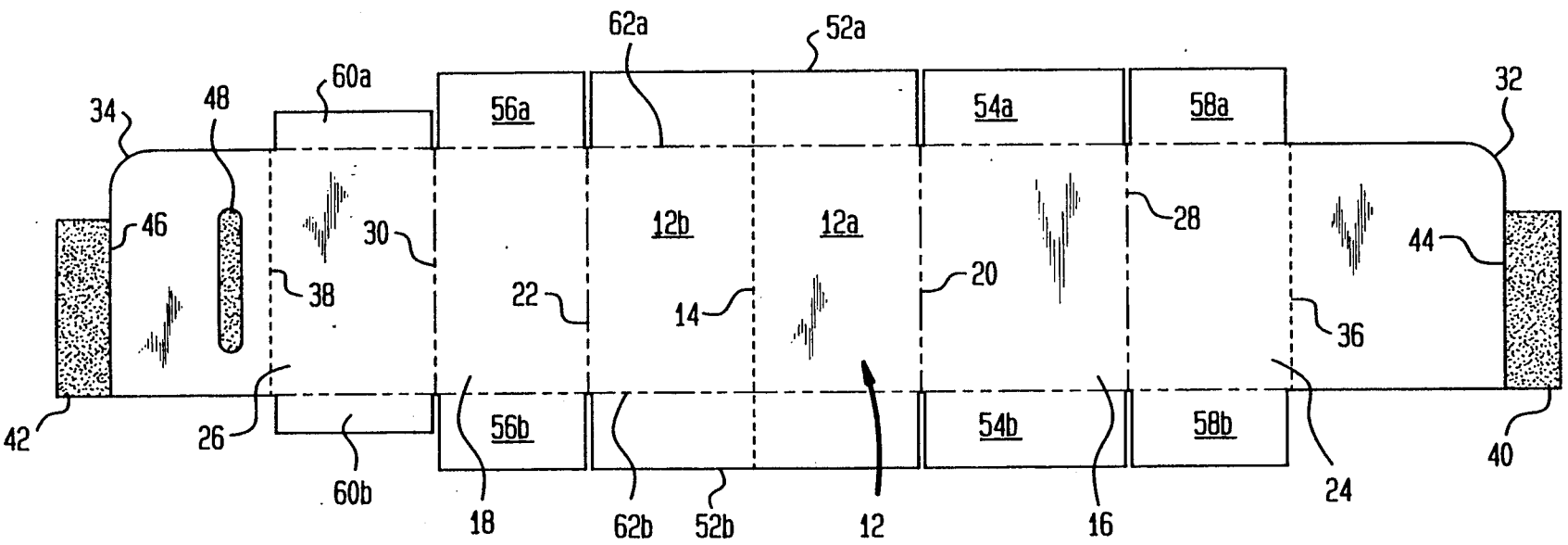
FIG. 1 is a plan view of a unitary blank constructed in accordance with one exemplary embodiment of the present invention.

Referring to FIG. 1, there is shown a unitary blank 10 which may be die cut from a sheet of corrugated by any well known means. The blank 10 is intended to be used for shipping purposes. Accordingly, a suitable grade of corrugated must be selected. While the blank 10 could be made from single-ply cardboard or any other suitable material, corrugated is preferred when the blank is to be used for shipping. The blank 10 has an exterior surface (which is visible in FIG. 1) and an interior surface (which is not visible in FIG. 1), the distinction between such surfaces becoming apparent from the following description of the present invention. Concerning the following description of the present invention, it is noted that the terminology employed to describe the blank 10 has been selected to coincide with the intended end use of the blank (i.e., when it is erected into a plural carton). Thus, while certain terms (e.g., "inner" and "outer") may seem to be inaccurate in connection with the description of FIG. 1, the appropriateness of such terms will become apparent in connection with the description of FIGS. 2–15.

Referring still to FIG. 1, the blank 10 includes a solid rear panel 12 which is rectangular in shape. A dividing line 14 divides the rear panel into left and right rear subpanels 12*a* and 12*b*. The dividing line 14 is indicia, such as a dashed line, printed visibly on the exterior surface of the rear panel 12. Alternately, the dividing line 14 can be a perforated tear line, a score line or a fold line. The location of the dividing line 14 in relation to the dimensions of the rear subpanels 12*a* and 12*b* will become apparent. Left and right outer panels 16 and 18 are located outwardly of the rear panel 12, and are delimited therefrom by fold lines 20 and 22, respectively. Left and right front panels 24 and 26 are located outwardly of the of the left and right outer panels 16 and 18, and are delimited therefrom by score lines 28 and 30, respectively. The rear, outer and front panels 12, 16, 18, 24 and 26 all have the same vertical dimension. According to one exemplary embodiment, the dividing line 14 bisects the rear panel 12 into two equidimensional subpanels 12*a* and 12*b*. Front panels 24 and 26 have the same dimensions as the left and right rear subpanels 12*a* and 12*b*, respectively. The left outer panel 16 is wider than the right outer panel 18.

Left and right inner panels 32 and 34 are located outwardly of the left and right front panels 24 and 26, and are delimited therefrom by score lines 36 and 38, respectively. The left and right inner panels 32 and 34 have the same basic dimensions as the left and right outer panels 16 and 18, respectively. Symmetrical glue laps 40 and 42 are located outwardly of the left and right inner panels 32 and 34, and are delimited therefrom by fold lines 44 and 46, respectively. The glue laps 40 and 42 are narrower in width than the rear subpanels 12*a* and 12*b*, respectively, and have a lesser vertical dimension than the inner panels 32 and 34 from which they depend, the purpose for which will be explained hereinafter. An adhesive, such as glue, is placed on the exterior surfaces of glue laps 40 and 42. On the exterior surface of the inner panel 34, a continuous bead of adhesive 48 is applied along the fold line 38. The thickness, bonding strength and function of the bead 48 of adhesive will become apparent as the blank 10 is described hereinafter.

Symmetrical top and bottom rear end flaps 52*a* and 52*b*, both of which are solid, depend from the rear panel 12. The dividing line 14 is extended from the rear panel 12 and located on the exterior surfaces of the top and bottom rear end flaps 52*a* and 52*b*. Symmetrical top and bottom side flaps 54*a* and 54*b* depend from the left outer panel 16, and symmetrical top and bottom side flaps 56*a* and 56*b* depend from right outer panel 18. Symmetrical top and bottom front end flaps 58*a* and 58*b* depend from the left front panel 24, and symmetrical top and bottom front end flaps 60*a* and 60*b* depend from the right front panel 26. Panels 12, 16, 18, 24 and 26 are delimited from their depending top flaps 52*a*, 54*a*, 56*a*, 58*a* and 60*a*, respectively, by fold line 62*a*, and from their depending bottom flaps 52*b*, 54*b*, 56*b*, 58*b* and 60*b*, respectively, by fold line 62*b*. The dimensions of the flaps will be discussed in connection with erecting the blank 10 into a carton.

The blank 10 has indicia printed on its exterior surface. For clarity, however, the indicia is not shown on the blank 10 illustrated in FIG. 1. The function of the indicia will be explained hereinafter.

Figure 2:
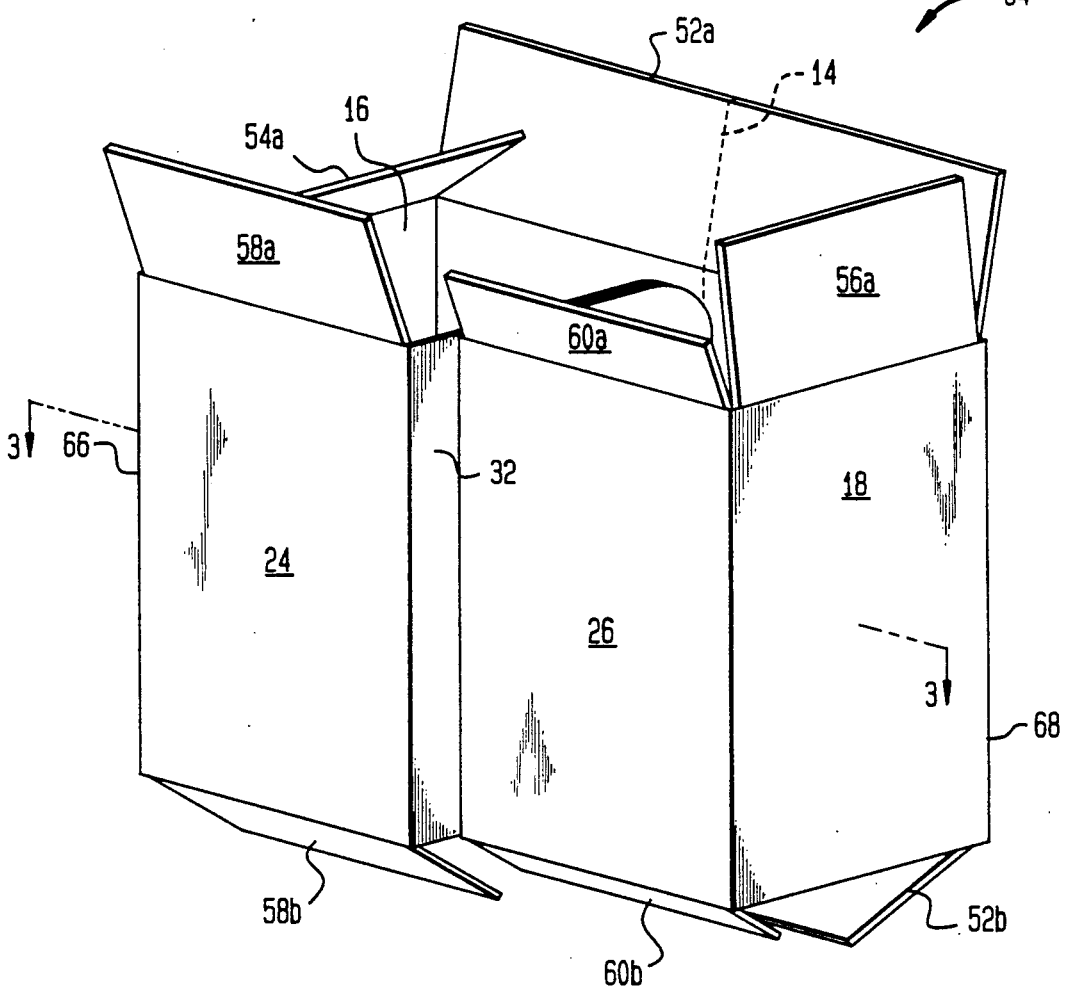
FIG. 2 is a front perspective view of a plural carton erected from the unitary blank illustrated in FIG. 1, the carton being shown in a partially erected state for purposes of clarity.
Figure 3:
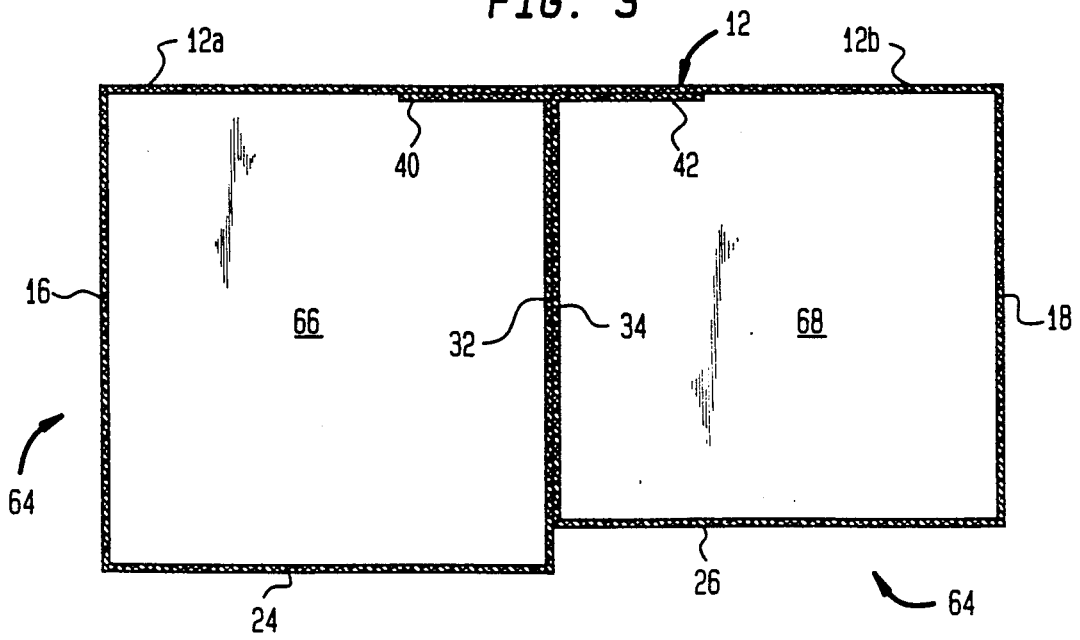
FIG. 3 is a cross-sectional view, taken along section line 3—3 in FIG. 2 and looking in the direction of the arrows, of the plural carton illustrated in FIG. 2, the bottom flaps being removed for purposes of clarity.
Figure 4:
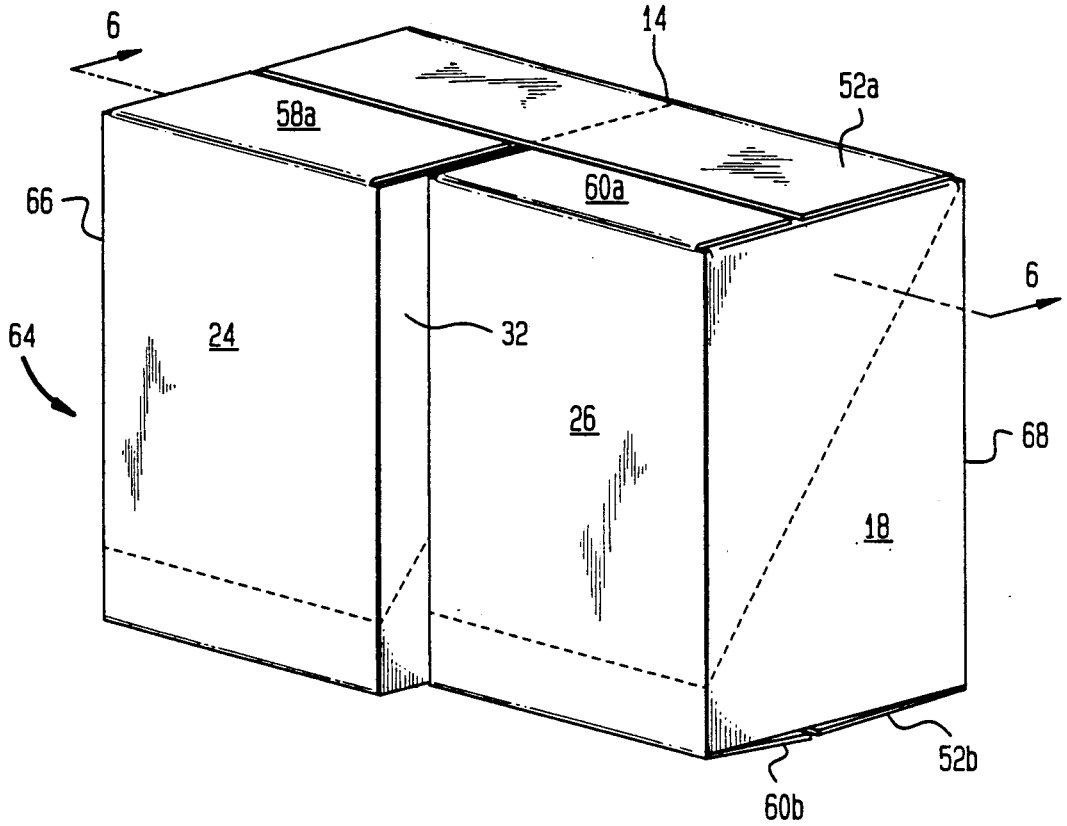
FIG. 4 is a front perspective view of a plural carton erected from the unitary blank illustrated in FIG. 1, the carton being shown in its fully erected state.
Figure 5:
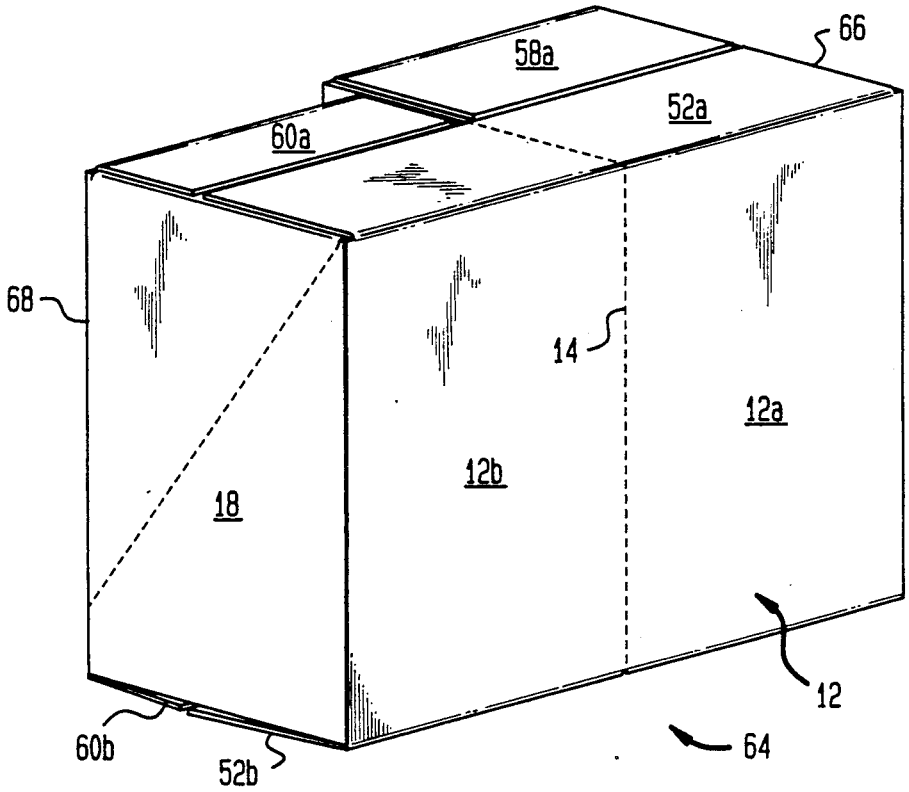
FIG. 5 is a rear perspective view of the plural carton illustrated in FIG. 4.
Figure 6:
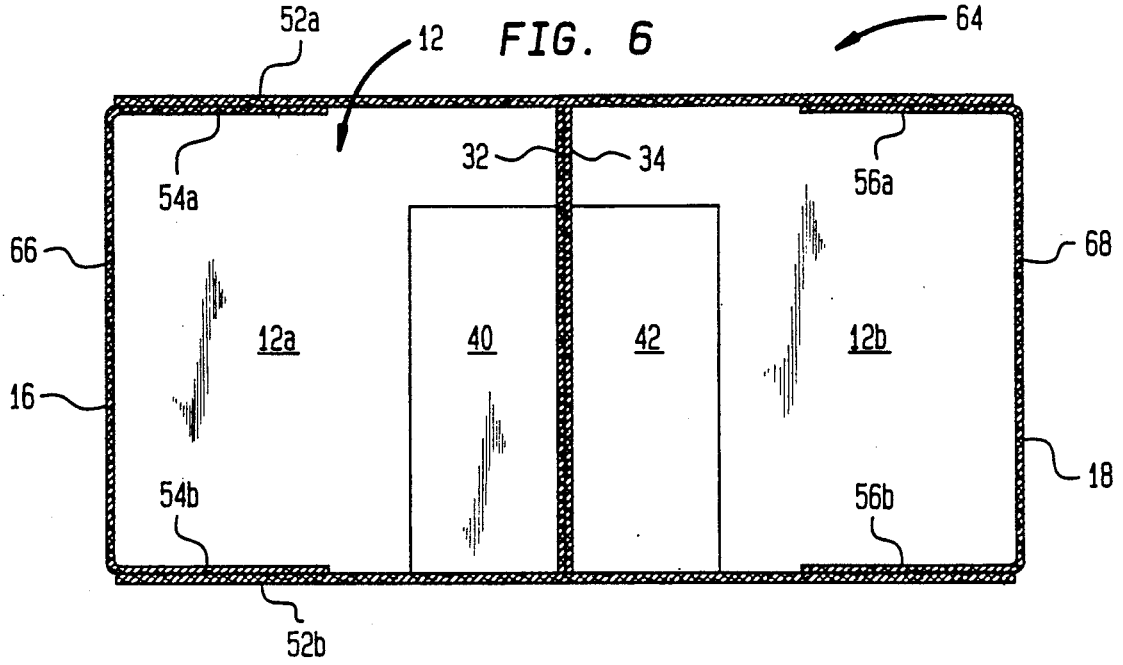
FIG. 6 is a cross-sectional view, taken along section line 6—6 in FIG. 4 and looking in the direction of the arrows, of the plural carton illustrated in FIG. 4.

Referring now to FIGS. 2–6, the blank 10 is folded into a plural carton 64 having rectangular left and right units 66 and 68. The left unit 66 is folded such that the left front panel 24 is parallel to left rear subpanel 12*a*, the left outer panel 16 is parallel to the left inner panel 32, and the left glue flap 40 is folded at a right angle to the left inner panel 32 and glued, via the adhesive on its exterior surface, to the left rear subpanel 12*a*. The right unit 68 is folded in a similar manner. The left and right units 66 and 68 are attached together by pressing their respective inner panels 32 and 34 together such that the bead of adhesive 48 forms a bond therebetween. The plural carton 64 erected thus far is shown in FIG. 2.

The plural carton 64 has its top covered by the top flaps 52*a*, 54*a*, 56*a*, 58*a* and 60*a*. The front and rear top end flaps 52*a*, 58*a* and 60*a* overlap top side flaps 54*a* and 56*a*. An adhesive, such as glue, can be placed on the exterior surface of the top side flaps 54*a* and 56*a* to glue the top end flaps 52*a*, 58*a* and 60*a* thereto. The bottom of the plural carton 64 is covered by the bottom flaps 52*b*, 54*b*, 56*b*, 58*b* and 60*b*. A person skilled in the art can appreciate that the top side flaps 54*a* and 56*a* and bottom side flaps 54*b* and 56*b* must have lengths sufficient to secure the top end flaps 52*a*, 58*a* and 60*a*, and the bottom end flaps 52*b*, 58*b*, and 60*b*, respectively. The front top end flaps 58*a* and 60*a* and the front bottom end flaps 58*b* and 60*b* do not overlap the rear top and bottom rear end flaps 52*a* and 52*b*, respectively, but instead are dimensioned to leave gaps therebetween. Because it is preferable that the left front end flaps 58*a* and 58*b* have the same lengths as the rear end flaps 52*a* and 52*b*, respectively, the right front end flaps 60*a* and 60*b* must have shorter lengths than the left front end flaps 58*a* and 58*b*. This is apparent since the left unit 66 is wider than the right unit 68.

Figure 7:
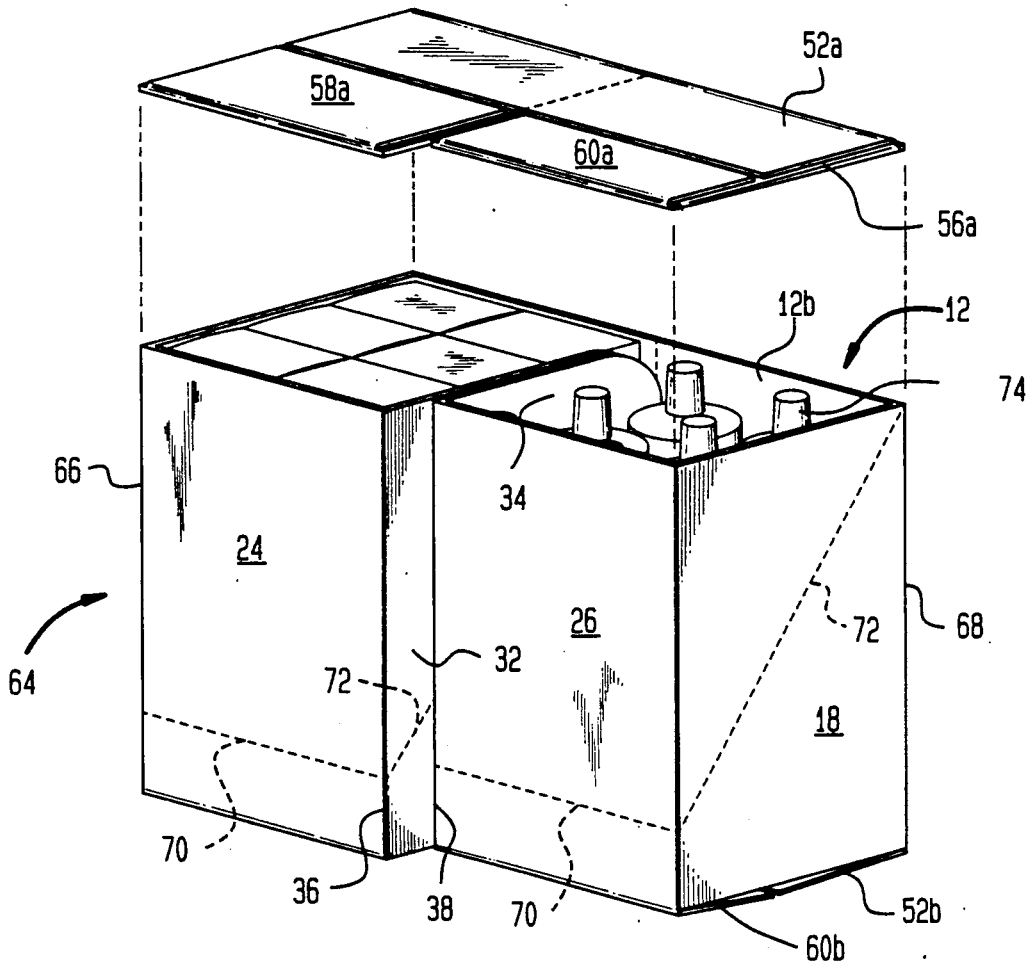
FIG. 7 is a front perspective view of the plural carton illustrated in FIG. 4, the carton being shown with its top separated and exploded away from the rest of the carton.
Figure 8:
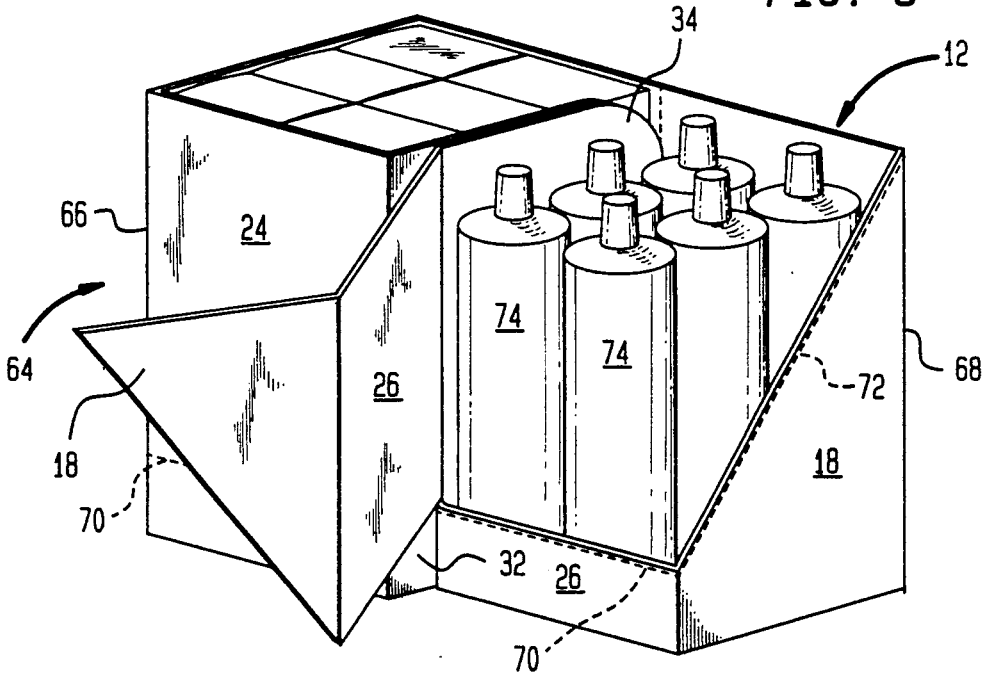
FIG. 8 is a front perspective view of the plural carton illustrated in FIG. 7, the plural carton being adapted for display.

Referring now to FIGS. 7–8, the top portion of the plural carton 64 is removed by cutting around the fold line 62*a* (see FIG. 1) and separating the top end flaps 52*a*, 54*a*, 56*a*, 58*a* and 60*a* from the rest of the carton 64. The plural carton 64 does not have inner side flaps depending from the inner panels 32 and 34 which would otherwise adhere to the top end flaps 52*a*, 58*a* and 60*a* and thereby would require additional cutting. With the top portion removed, the plural carton 64 can be adapted for display. Indicia, such as horizontal dashed lines 70, are printed on the exterior surfaces of the front panels 24 and 26, and diagonal dashed lines 72 are printed on the exterior surfaces of the outer panels 16 and 18 and inner panels 32 and 34 to provide guidelines for adapting the plural carton 64 for display. On the front panels 24 and 26, the horizontal dashed lines 70 are located substantially towards the bottom front end flaps 58*b* and 60*b*, respectively. On the outer panels 16 and 18 and inner panels 32 and 34, the diagonal dashed lines 72 slope upwards from the front of the plural carton to the rear thereof. The right unit 68 is adapted to display its products 74, such as bottles and boxes, by cutting along the dashed lines 70 and 72, folding back the removed portions of the front and outer panels 26 and 18 about the score line 38, and cutting the score line 38. The score line 38 is cut from the inside to prevent the products 74 from being damaged. The remaining portion of the outer panel 18 provides structural support for the rear panel 12. To adapt the left unit 66 for display, the front and outer panels 24 and 16 are cut away in a similar manner. Although the outer panels 16 and 18 are partially removed, the inner panels 32 and 34 are not cut, nor are they separated, but instead remain glued together as a solid member to provide a structural support member which will be described hereinafter.

Alternately, the top portion can be removed by cutting around the periphery of the plural carton 64 above the glue laps 40 and 42. First, the panels 12, 14, 16, 18, 24 and 26 are cut, leaving the top portion attached to the left and right inner panels 32 an 34. Then, the front panels 24 and 26 are separated from their respective inner panels 32 and 34 by cutting along the score lines 36 and 38. The use of score lines 36 and 38 instead of indicia, such as fold lines, facilitates easier separation. Thus, the top portion is removed without having to cut the glue laps 40 and 42 from the rear panel 12. In this manner, the shortened glue laps 40 and 42 facilitate fast and easy removal of the top portion of the plural carton 64.

Figure 9:
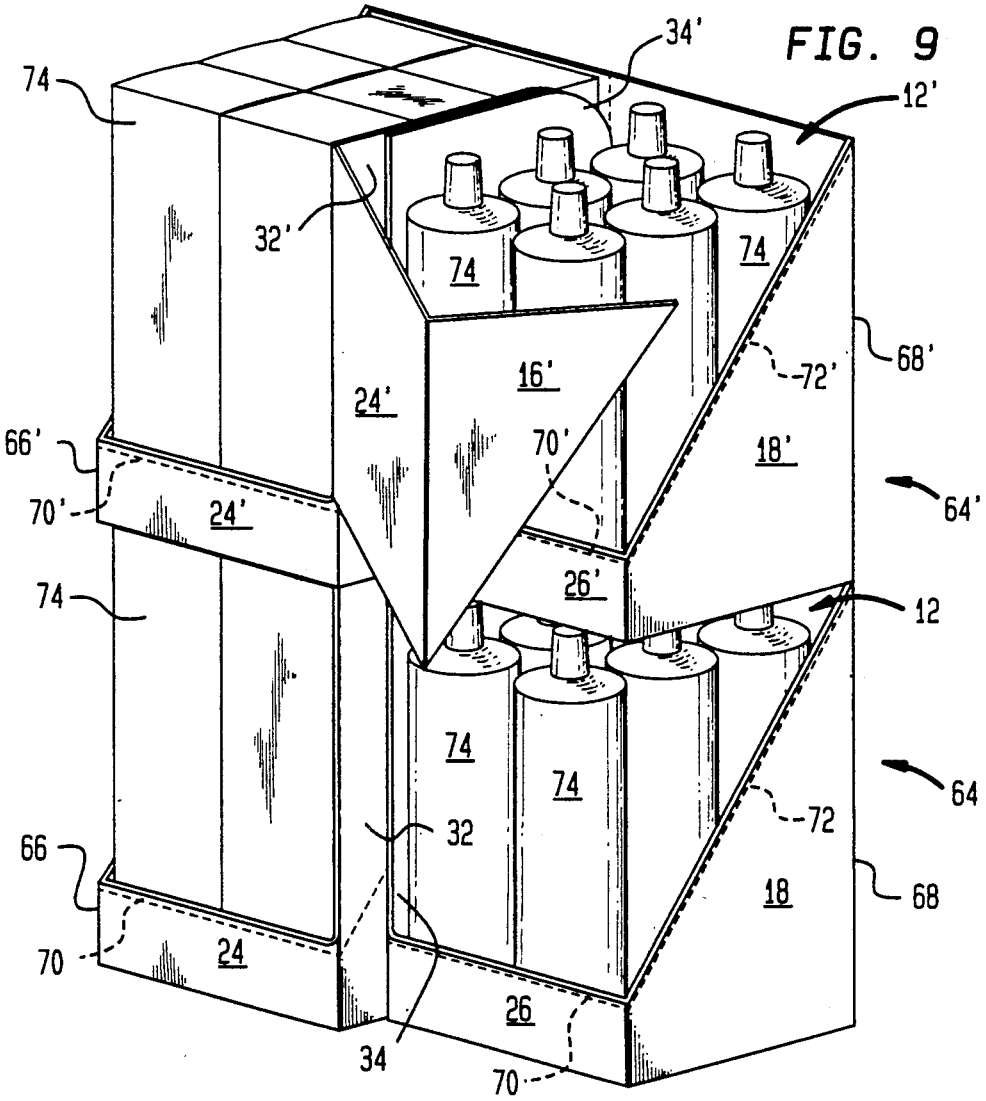
FIG. 9 is a front perspective view of two plural cartons stacked one on top of the other, each plural carton being identical to the plural carton illustrated in FIG. 8.

Referring now to FIG. 9, the plural carton 64, which has been adapted for display purposes, is stacked atop an identical plural carton 64'. Even though substantial portions of the outer panels 16' and 18' of the bottom carton 64' are removed, the inner panels 32' and 34' brace the rear panel 12' and cooperate therewith to provide structural support for the upper carton 64. The inner panels 32' and 34' form a solid structural support member which exhibits greater stacking strength than a support member containing openings, apertures and the like. Thus, the use of the inner panels 32' and 34' as a solid structural support member eliminates the need for additional construction requiring interior fillers or complex machinery. Therefore, the plural carton 64' can be adapted for display in a stackable fashion even though much of its face surface has been removed.

Figure 10:
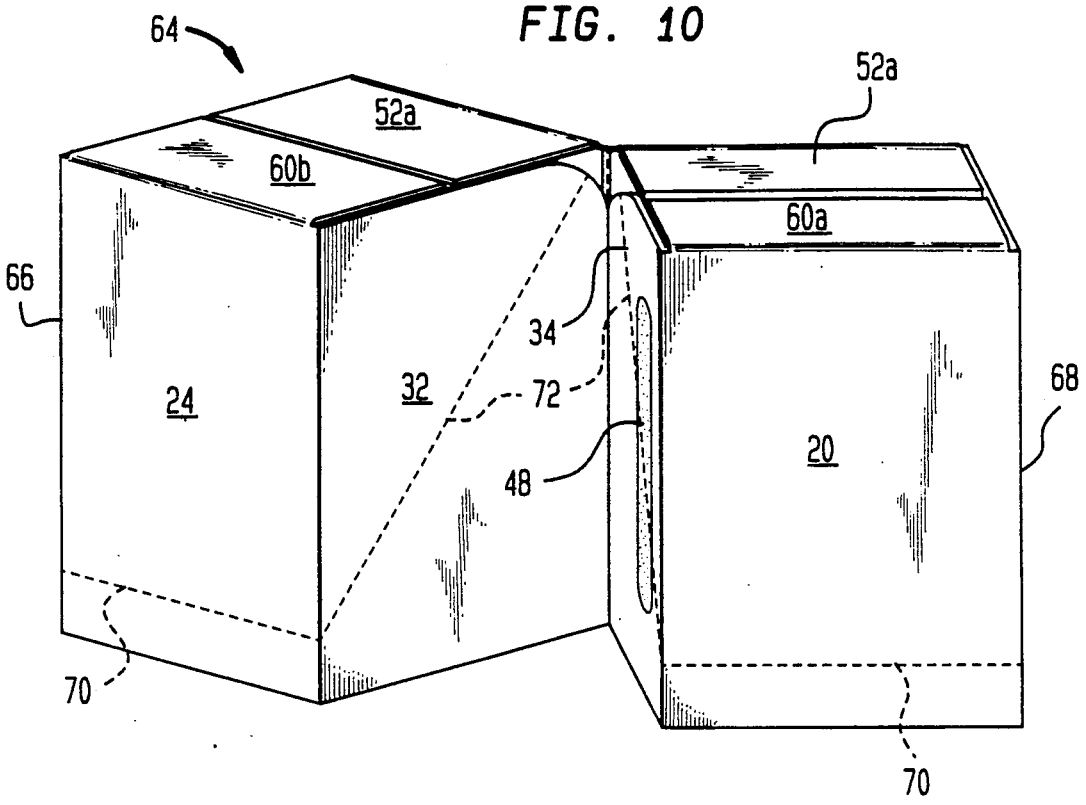
FIG. 10 is a front perspective view of a plural carton erected from the unitary blank illustrated in FIG. 1, the plural carton being fully erected and split into two separate units.
Figure 11:
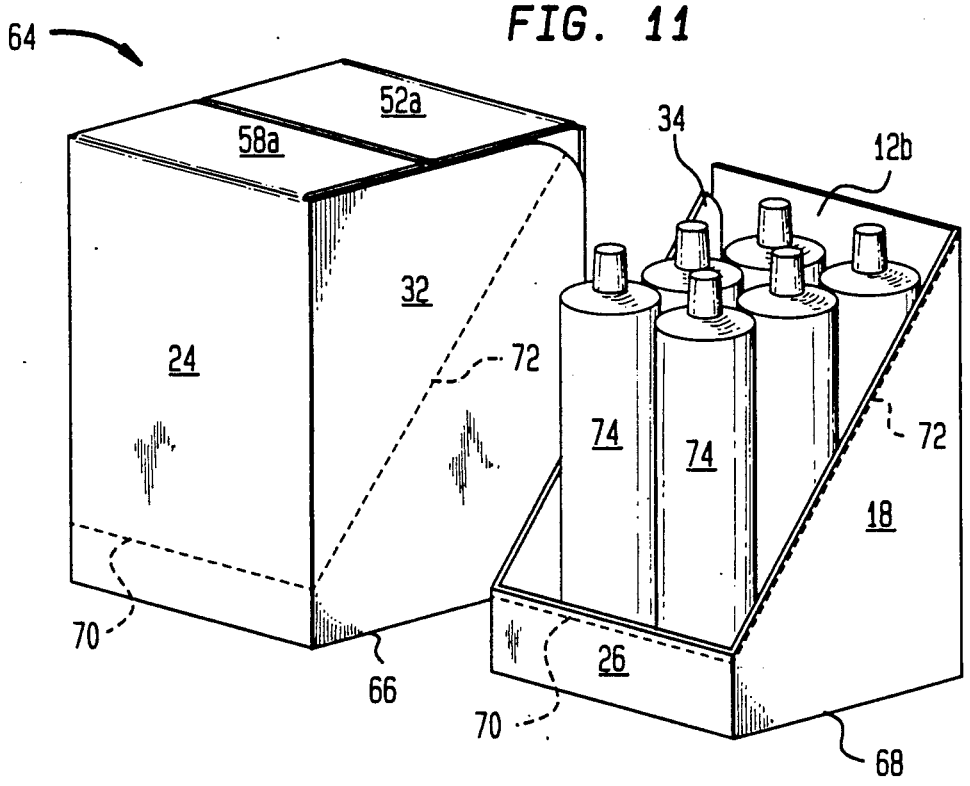
FIG. 11 is a front perspective view of the plural carton illustrated in FIG. 10, the right unit being adapted for display.

Referring now to FIGS. 10–11, the plural carton 64 is shown being split into two independent units 66 and 68. First, the units 66 and 68 are bent about the dividing line 14, thereby breaking the bond formed by the bead of adhesive 48 and separating the inner panels 32 and 34. Then the dividing line 14 is cut or torn. Despite being split, the top flaps 52*a*, 54*a* and 58*a* remain glued together to cover the top of the left unit 66, and the bottom flaps 52*b*, 54*b* and 58*b* remain glued together to cover the bottom of the left unit 66. Similarly, the right unit 68 is covered by the top flaps 52*a*, 56*a* and 60*a* and the bottom flaps 52*b*, 56*b* and 60*b*.

Once the plural carton 64 is split, the individual units 66 and 68 can be adapted for display. The right unit 68 is adapted for display by removing top flaps 52*a*, 56*a* and 60*a* (not shown) and cutting along the horizontal dashed lines 70 and diagonal dashed lines 72 to remove substantial portions of the outer, front and inner panels 18, 26 and 34. The remaining triangular sections of the inner and outer panels 34 and 18 brace the rear subpanel 12*b*. In the same manner, the left unit 66 can be adapted for display. Thus, the products 74 stored within the independent units 66 and 68 are made readily accessible.

Two other exemplary embodiments of a plural carton constructed in accordance with alternate embodiments of the present invention are illustrated in FIGS. 12–13 and FIGS. 14–15, respectively. Elements illustrated in FIGS. 12–13 and FIGS. 14–15 which correspond to the elements described above with respect to FIGS. 1–11 have been designated by corresponding reference numerals increased by one hundred and two hundred, respectively. The embodiments of FIGS. 12–13 and FIGS. 14–15 function in the same manner as the embodiment of FIGS. 1–11 unless otherwise stated.

Figure 12:
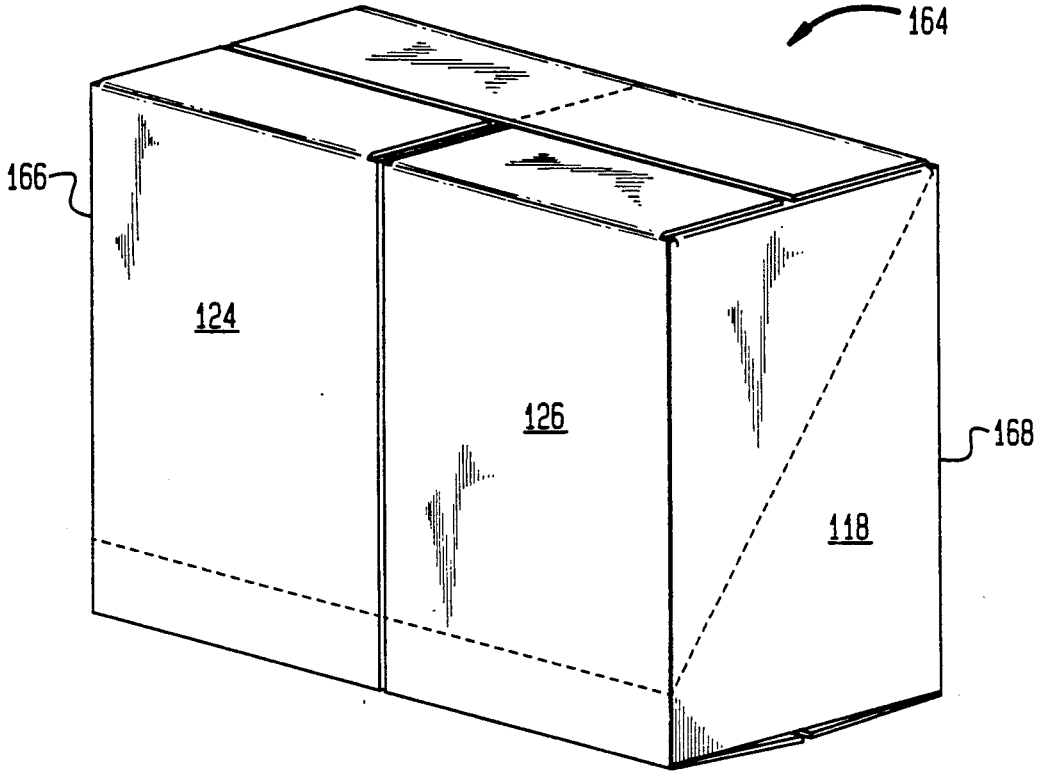
FIG. 12 is a front perspective view of another exemplary embodiment of a plural carton constructed in accordance with the present invention.
Figure 13:
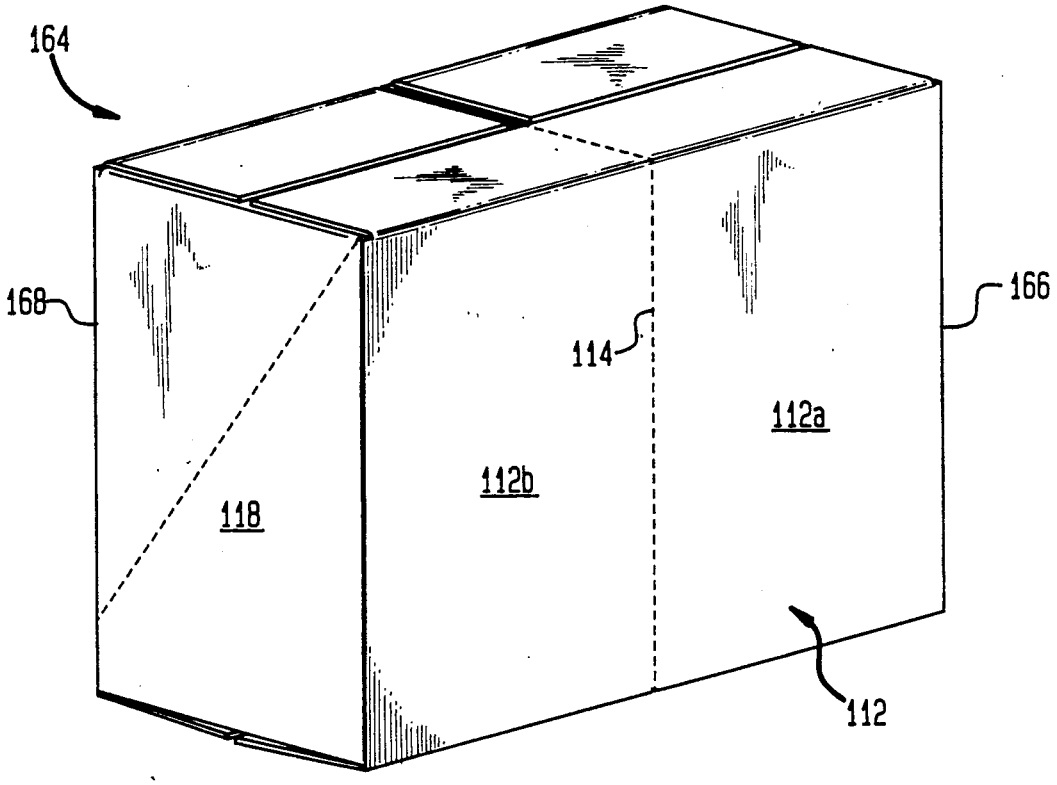
FIG. 13 is a rear perspective view of the plural carton illustrated in FIG. 12.

With reference to FIGS. 12–13, a plural carton 164 includes a dividing line 114, which bisects a rear panel 112 into two equi-dimensional subpanels 112*a* and 112*b*. Front panels 124 and 126 have the same dimensions as their opposed rear subpanels 112*a* and 112*b*. All inner and outer panels 116, 118, 132 and 134 (the inner panels not being visible) have the same dimensions. Therefore, a left unit 166 has the same storage capacity as a right unit 168.

Figure 14:
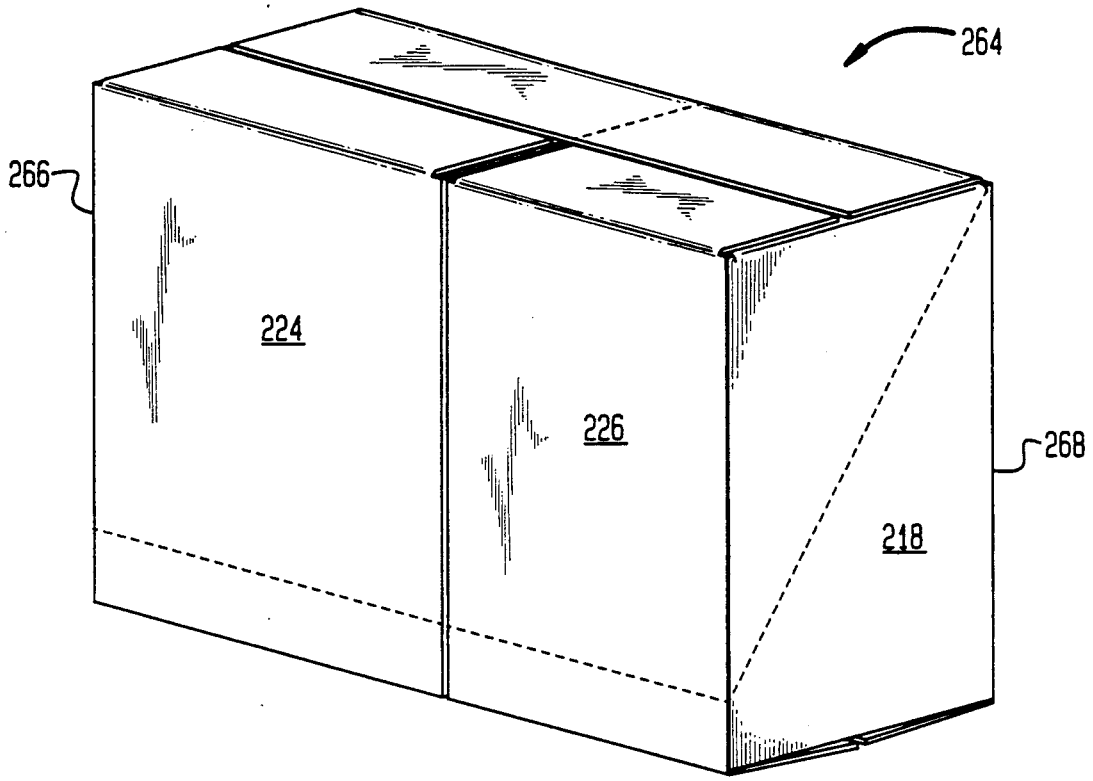
FIG. 14 is a front perspective view of still another exemplary embodiment of a plural carton constructed in accordance with the present invention.
Figure 15:
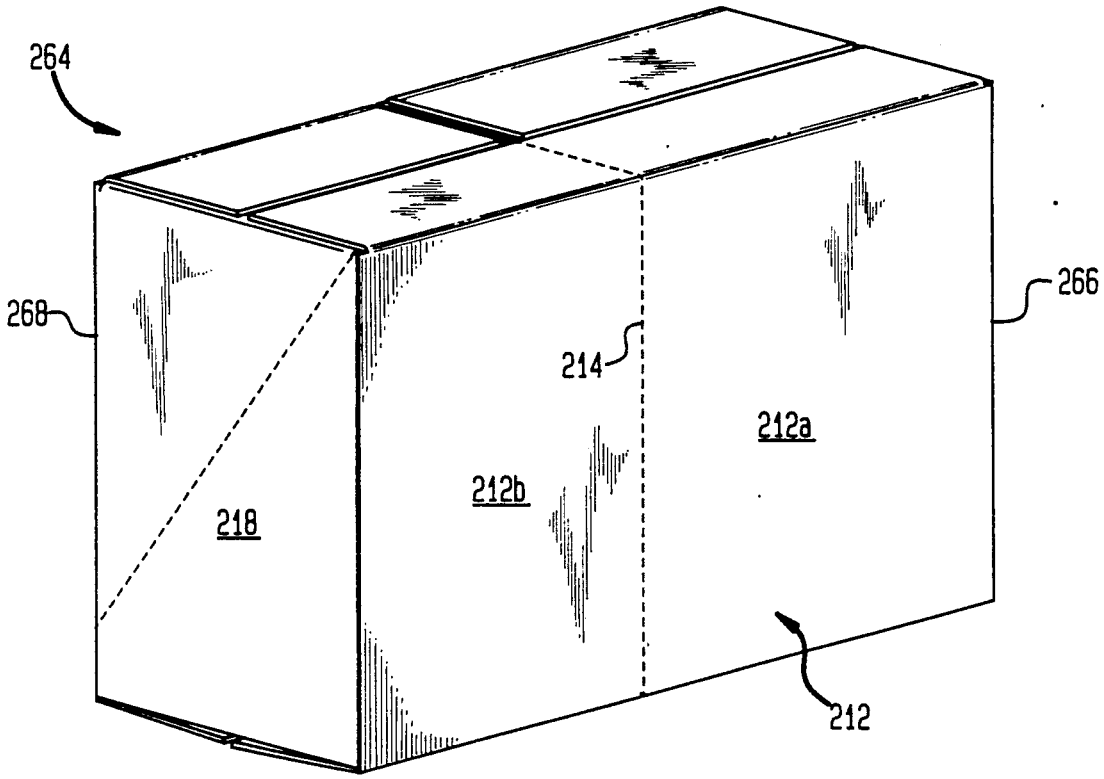
FIG. 15 is a rear perspective view of the plural carton illustrated in FIG. 14.

Referring now to FIGS. 14–15, a plural carton 264 includes a dividing line 214, which bisects rear panel 212 such that rear subpanel 212*a* is wider than rear subpanel 212*b*. Front panels 224 and 226 have the same dimensions as their opposing rear subpanels 212*a* and 212*b*. All inner and outer panels 216, 218, 232 and 234 (the inner panels not being visible) have the same dimensions. Therefore, left unit 266 has a greater storage capacity than right unit 268.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. A stackable plural carton made from a unitary blank and adapted for shipping and display purposes, comprising:

a rear panel subdivided into first and second rear subpanels, said rear panel having an upper edge, a lower edge and first and second side edges;

a first outer panel having an upper edge, a lower edge and first and second side edges, said first side edge of said first outer panel being connected to said first side edge of said rear panel;

a second outer panel having an upper edge, a lower edge and first and second side edges, said first side edge of said second outer panel being connected to said second side edge of said rear panel;

a first front panel having an upper edge, a lower edge and first and second side edges, said first side edge of said first front panel being connected to said second side edge of said first outer panel;

a second front panel having an upper edge, a lower edge and first and second side edges, said first side edge of said second front panel being connected to said second side edge of said second outer panel;

a first inner panel having an upper edge, a lower edge and first and second side edges, said first side edge of said first inner panel being connected to said second side edge of said first front panel;

a second inner panel having an upper edge, a lower edge and first and second side edges, said first side edge of said second inner panel being connected to said second side edge of said second front panel;

first attaching means for attaching said second side edge of said first inner panel to said first rear subpanel such that said first rear subpanel, said first outer panel, said first front panel and said first inner panel form a first container having an upper end and a lower end;

second attaching means for attaching said second side edge of said second inner panel to said second rear subpanel such that said second rear subpanel, said second outer panel, said second front panel and said second inner panel form a second container having an upper end and a lower end;

third attaching means for attaching said first and second inner panels together in a face-to-face manner such that said first and second containers are positioned side-by-side, said first and second inner walls forming a structural support member having rigidity sufficient to support another carton placed upon said plural carton;

a first group of flaps substantially covering said lower ends of said first and second containers, said first group of flaps including a first flap attached to said lower edge of said rear panel, a second flap attached to said lower edge of said first outer panel, a third flap attached to said lower edge of said second outer panel, a fourth flap attached to said lower edge of said first front panel, and a fifth flap attached to said lower edge of said second front panel; and a second group of flaps substantially covering said upper ends of said first and second containers, said second group of flaps including a sixth flap attached to said upper edge of said rear panel, a seventh flap attached to said upper edge of said first outer panel, an eighth flap attached to said upper edge of said second outer panel, a ninth flap attached to said upper edge of said first front panel, and a tenth flap attached to said upper edge of said second front panel, none of said flaps of said second group of flaps being attached to said upper edges of said first and second inner panels, whereby said upper ends of said first and second containers can be opened by cutting said upper edges of said rear panel, said first and second outer panels, and said first and second front panels, and by removing said second group of flaps therefrom.

2. A plural carton according to claim 1, wherein said ninth and tenth flaps do not overlap said sixth flap.

3. A plural carton according to claim 2, further including an adhesive applied to said seventh and eighth flaps, whereby said sixth flap is bonded to said seventh and eighth flaps, said ninth flap is bonded to said seventh flap, thereby covering said upper end of said first container, and said tenth flap is bonded to said eighth flap, thereby covering said upper end of said second container.

4. A plural carton according to claim 1, wherein said first and second inner panels are solid.

5. A plural carton according to claim 1, wherein said first and second inner panels are detachable such that said two side-by-side containers can be split into two independent containers.

6. A plural carton according to claim 5, wherein said first and second attaching means are first and second glue laps connecting said second ends of said first and second inner panels, respectively, to said first and second rear subpanels, respectively.

7. A plural carton according to claim 6, wherein said first and second inner panels have a greater vertical dimension than said first and second glue laps.

8. A plural carton according to claim 6, wherein said third attaching means is a bead of adhesive placed between said first and second inner panels, said bead being disposed along said side respective first side edges of said first and second inner panels.

9. A plural carton according to claim 1, further comprising indicia placed visibly upon said plural carton for adapting said plural carton for display.

10. A plural carton according to claim 9, wherein said indicia includes a dividing line for subdividing said rear panel.

11. A plural carton according to claim 10, wherein said dividing line bisects said rear panel such that said first and second rear subpanels have the same dimensions, and wherein said first inner panel is wider than said second inner panel, and wherein said ninth flap is longer than said tenth flap, whereby said first container has a greater storage capacity than said second container.

12. A plural carton according to claim 10, wherein said dividing line bisects said rear panel such that said first and second rear subpanels have the same dimensions, and wherein said first and second inner panels have the same dimensions, whereby said first container has the same storage capacity as said second container.

13. A plural carton according to claim 10, wherein said dividing line bisects said rear panel such that said first rear subpanel is wider than said second rear subpanel, and wherein said first and second inner panels have the same dimensions, whereby said first container has a greater storage capacity than said second container.

14. A plural carton according to claim 1, wherein said another carton is substantially identical to said plural carton.

15. A plural carton according to claim 1, wherein said plural carton is fabricated from corrugated cardboard.

* * * * *